US005361808A

United States Patent [19]

Bowen, Jr

[11] Patent Number: 5,361,808

[45] Date of Patent: Nov. 8, 1994

[54] PAPERMAKER'S FABRIC CONTAINING FINNED WEFT YARNS

[76] Inventor: David Bowen, Jr, 9349 Old A1A, St. Augustine, Fla. 32086

[21] Appl. No.: 163,526

[22] Filed: Dec. 9, 1993

[51] Int. Cl.[5] ..... D03D 15/00; D03D 3/04

[52] U.S. Cl. ..... 139/383 A; 139/426 R; 57/248; 428/397

[58] Field of Search ..... 139/426 R, 383 A; 428/397; 57/248

[56] References Cited

U.S. PATENT DOCUMENTS 3,158,984 12/1964 Butler ..... 139/426 R X
4,633,596 1/1987 Josef ..... 139/383 A
4,707,409 11/1987 Phillips ..... 428/397
5,097,872 3/1992 Laine et al. ..... 139/383 A

*Primary Examiner*—Andrew M. Falik

[57] ABSTRACT

A woven papermakers' fabric containing warp and weft yarns wherein the weft yarns are monofilaments characterized by having two or more thin readily deformable fins or lobed extensions. By replacing the currently used round monofilaments or twisted and cabled weft yarns, these inventive finned monofilaments produce fabrics with significantly broadened permeability range control and stabilize the fabric against mechanical distortion.

3 Claims, 1 Drawing Sheet

PAPERMAKER'S FABRIC CONTAINING FINNED WEFT YARNS

BACKGROUND OF THE INVENTION

In the preparation of paper, woven fabric belts are utilized to support the cellulosic pulp fibers as they are moved through the papermaking process and converted from a thin slurry into finished paper. It has been found that mechanical stability and permeability control of these belts is critical to the production of consistent, high quality paper. As paper machine speeds have increased, fabrics designed for use in the dryer sections of papermaking machines have had their targeted permeability reduced from 500 cubic feet per minute per square foot with a pressure differential of one half inch of water to 100 or less. There has also been a trend toward use of thinner fabric constructions to minimize differential forces on the paper as it passes over and under the belts in certain process steps. These two papermakers' fabric requirements are in conflict, since the common way to reduce permeability is to increase size of the weft yarn or the number of picks per inch, both of which can result in increased fabric thickness.

DESCRIPTION OF THE PRIOR ART

As the demand for papermakers' and industrial fabrics has moved toward thinner, reduced permeability fabrics, suppliers of such fabrics have shifted from use of round monofilament wefts to use of twisted and cabled yarn constructions which have more capability to conform into the interstitial spaces formed at the crossings of warp and weft yarns. This switch has been moderately successful in regards to production of lower permeability and improved fabric stability. Some negative results of this practice are that the smaller monofilaments used in cabled constructions are more easily damaged by severe environmental exposure and that cabled yarns tend to become contaminated with process "tars" faster than true monofilament wefts. The extra handling and processing stages required to produce these twisted and cabled yarns also makes their cost significantly higher than that of monofilament.

There has also been a shift toward use of more ribbon-like warp yarns. These warps give improved paper contact and reduce the number of interstices, thus resulting in reduced fabric permeability. Wear due to the thin profile of these warp yarns and a tendency toward reduced fabric stability have been the key drawbacks to more widespread use of this concept.

Fabric stability is improved by increasing the interaction between warp and weft yarns. Current methods of improving stability include increasing pick count, use of multifilament warps and/or wefts, use of cabled weft yarns, and application of resinous fabric treatments. Each of the listed methods is acceptable in selected areas, but all carry a cost or performance penalty which prevent them from being generally acceptable.

In U.S. Pat. No. 5,097,872, Laine et. al. teach the use of an X shaped fiber to achieve improved fabric stability, but their application requires almost complete flattening of the fiber on one side by bending and the design use described would not contribute to improved permeability control. In contrast, the current patent application requires that weft fiber lay relatively flat in the fabric and that the fins distort only at warp and weft intersections, otherwise remaining erect to block fabric interstitial spaces.

In U.S. Pat. No. 4,633,596, Josef teaches the use of warp fibers having a center thinner than the edges and which improves fabric dimensional stability by minor distortion at warp and weft crossings. This is in marked contrast to the use of finned weft fibers which will always be thicker at their center than at their edges. The drawings and discussion of this patent tend to lead toward production of fabric designs targeted toward high permeability fabrics.

SUMMARY OF THE INVENTION

The present invention provides thin papermaking fabrics, especially dryer fabrics, with the capability of being easily woven on standard industrial looms, which can be produced with a wide range of permeabilities, especially including the desired low permeability targets of less than 100 cubic feet per minute per square foot with a pressure differential of one half inch of water. Fabrics utilizing this invention also have improved dimensional stability over that achieved by the now common use of twisted and plied monofilament wefts.

Specifically, this invention provides, in a woven papermakers' fabric, the improvement wherein some or all of the weft yarns are monofilaments designed to have two or more finned extensions which are deformed when crossed by warp yarns and which otherwise extend into and block the interstitial spaces of said fabric. Preferably these weft yarns will have four or more fins so as to not be sensitive to the minor twist insertion present in normal weaving operations. Preferred maximum dimensions of these wefts will generally range from 0.7 to 1.5 times the cross-sectional thickness of the warp yarn with which it is used. Any appropriate polymer type and additive package used to produce yarns for papermakers' fabrics may be used. Significant economic benefits are realized due to reduced denier of finned wefts over other weft yarns previously used for this service.

DETAILED DESCRIPTION OF THE INVENTION

The finned monofilaments used in the present invention can be prepared from a variety of thermoplastic materials. Polyethylene terphthalate, polyphenylene sulphide and 1,4-polydicyclohexanol terphthlate are currently widely used. In order to obtain the desired fin flexibility, these new weft yarn designs often require addition of polymer specific plasticizing agents during the monofilament extrusion process. Use of standard additive recipes which may include heat and hydrolysis stabilizers, contaminant release agents, and other such processing aids common to production of papermakers' yarns is considered as standard.

Figure 1:
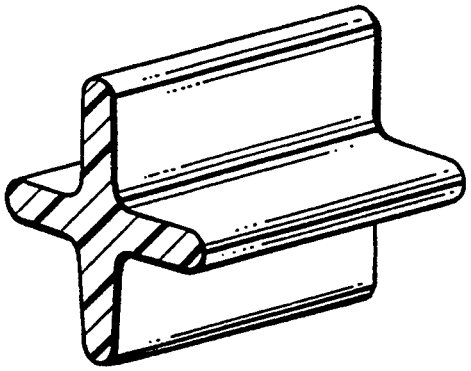
FIG. 1 is a cross sectional perspective view of the preferred embodiment for the weft yarn of the invention.
Figure 2:
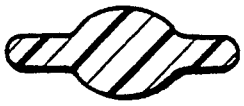
FIGS. 2 through 5. are examples of other cross sections which yarns of this invention could assume.
Figure 3:
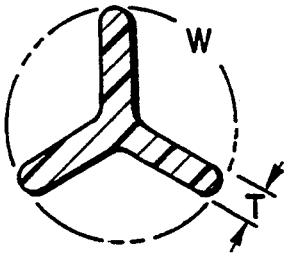
Figure 4:
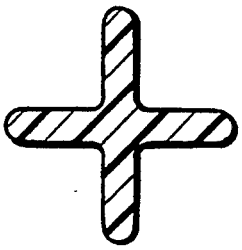
Figure 5:
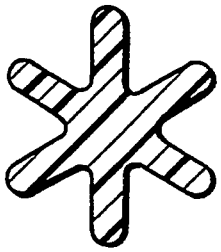

Modifications to customary techniques for monofilament production are required in order to achieve acceptable filament smoothness and uniformity for these new weft shapes. This is caused by the large overall monofilament width to fin thickness ratio necessary to obtain the required flexibility without fracture. This ratio can be used as a specification for these weft monofilament shapes and will be greater than 2.5, most preferably in the range from 5 to 20. In FIG. 3, this concept is illustrated by showing the effective fiber width as W and the effective fin thickness as T. W divided by T is the shape factor considered for the purpose of this invention. Since these heavy denier monofilaments are water quenched during production, there is a tendency for water to collect at the interior intersections of the fins and the central body of the filament. Unless this water is removed, significant diameter and size irregularities occur in subsequent drawing and stabilizing stages of the yarn production process. It is thought that the difficulty of achieving smooth, uniform fibers using standard monofilament production techniques has contributed to fibers of this type not being conceived for use in the quality demanding industrial fabric market. It has been found that passing these finned monofilaments through an air jet system after each water or fluid immersion is sufficient to prevent this type problem by forcibly removing fluid from internal intersections. Care must also be exercised in the drawing and winding operations to minimize permanent distortion of the filament shape.

Figure 6:
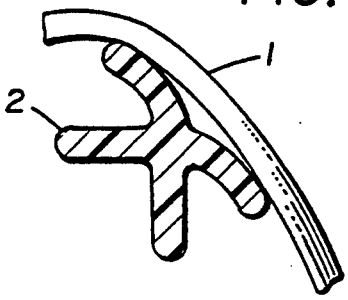
FIG. 6 shows local distortion of the weft fins by the crossing warp yarn.
Figure 7:
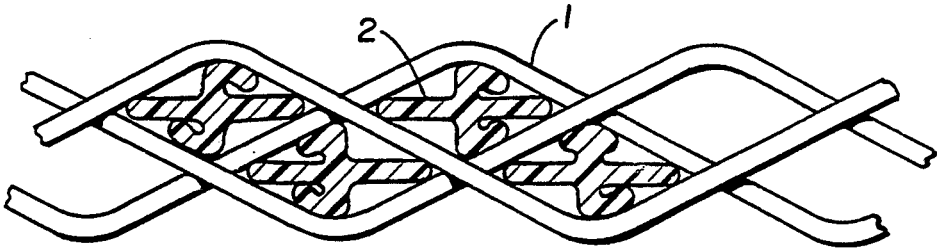
FIG. 7 shows a cross sectional view of a fabric illustrating the concepts of this invention. The weft yarns are easily deformed into the spaces between the warp yarns and provide both a locking together of the fibers and blockage of the volume between the warps.

Fabrics are woven from these new finned wefts in the same manner as with round monofilament and twisted and plied weft constructions currently in common use. In FIGS. 6 and 7, warp yarn is shown as 1 and weft yarn as 2. Bending of the weft fins by the warp during weaving is shown. FIG. 7 shows a fabric cross section showing use of all finned weft yarns. The important concept here is that the wefts easily conform to fill the available volume between the warp yarns and by so doing, lock the woven structure together and significantly reduce the openess of the fabric. Wefts containing less than four finned extensions are often found to be sensitive to the slight twist inserted into the weft as it is supplied to the process over the top of supply bobbins. This twist insertion results in small surface and permeability irregularities which can be significant in critical product areas. The X design has been found to very closely match the rectangular or diamond open area common to most weave patterns and is also a very good compromise for economy of material and ease of water removal during spinning. Use of more than four lobes reduces the importance of weft yarn orientation in the fabric, but at a cost of more monofilament extrusion difficulty. Fins with curved or tapered shapes may be used.

The use and advantages of the invention will be illustrated by the following examples. Values for woven fabric permeability are determined by measurements utilizing the industry standard Frazier permeometer test method and fabric stability measurements are made by determination of the deflection under load of a 10 inch square fabric sample mounted in a hinged frame.

1. A papermakers' dryer fabric is made utilizing a rectangularly shaped warp yarn with dimensions of 0.35 by 0.53 mm with 53 ends per inch and a weft yarn 0.50 mm in diameter inserted at 32 picks per inch. Permeability is determined to be 450 cfm and fabric deflection is 0.90 inch. Denier of this weft is 2500 and the cost is $2.80 per pound.

2. A papermakers dryer fabric is made in the same manner as in example 1, but an X shaped monofilament weft yarn with overall width of 0.60 mm and fin thickness of 0.08 mm is used. This weft yarn is characterized by a width to thickness ratio of 7.5. Permeability is determined to be 125 cfm and fabric deflection is 0.45 inch. Denier of this weft is 1150 and the cost is $3.30 per pound.

3. A papermaker's dryer fabric is made in the same manner as in example 1, but twisted and plied yarn containing a total of eight 0.2 mm monofilaments is used as the weft. Permeability is determined to be 250 cfm and fabric deflection is 0.60 inch. Denier of this weft is 3200 and the cost is $5.75 per pound.

4. A papermakers' dryer fabric is made in the same manner as in example 1, but an X shaped monofilament weft yarn with overall width of 0.50 mm and fin thickness of 0.10 mm is used. This weft yarn is characterized by a width to thickness ratio of 5. Permeability is determined to be 300 cfm and fabric deflection is 0.55 inch. Denier of this weft yarn is 1350 and the cost is $3.30 per pound.

In the examples shown, the lower denier of the finned weft yarns makes their effective product cost approximately half that of the competing round monofilament weft and about one quarter that of the plied and cabled monofilament weft. Permeability variation can be obtained both by pick count adjustment or by use of different shapes. Fabric stability is well below the acceptable limit of 1.0 for all products except the round monofilament design.

What is claimed is:

1. A woven papermaker's fabric having warp and weft yarns, said fabric being characterized in that at least a portion of the weft yarns consist of a single monofilament larger than 200 denier having between two and six finlike extensions, said monofilament having an overall width to fin thickness ratio of from 5 to 20, said weft yarns being arranged in the fabric to lie substantially straight with the warp yarns bending around them so that said finlike extensions significantly bend and distort only at intersections of the warp and weft yarns, otherwise remaining extended to fill the interstitial voids of the fabric whereby reduced fabric permeability and improved fabric stability are attained.

2. The woven papermaker's fabric of claim 1, wherein each of the weft yarns having a maximum cross-sectional dimension falling in the range of 0.7 to 1.5 times the thickness of the warp yarns.

3. A woven papermaker's fabric having warp and warp yarns, said fabric being characterized in that at least a portion of the weft yarns consist of from two to ten filaments, all or a portion of said filaments have from two to six finlike extensions and an overall filament width to fin thickness ratio of from 5 to 20, said weft yarns being arranged to lie substantially straight in the fabric with the warp bending around them so that said finlike extensions significantly bend and distort only at intersections of the warp and weft yarns, otherwise remaining extended to fill the interstitial voids of the fabric whereby reduced fabric permeability and improved fabric stability are attained.

* * * * *

UNITED STATES PATENT AND TRADEMARK OFFICE

CERTIFICATE OF CORRECTION

PATENT NO. : 5,361,808

DATED : November 8, 1994

INVENTOR(S) : David Bowen, Jr,

It is certified that error appears in the above-indentified patent and that said Letters Patent is hereby corrected as shown below:

Column 4, line 55, "warp" should read --weft--

Signed and Sealed this

Fourth Day of April, 1995

*Attest:*

BRUCE LEHMAN

*Attesting Officer*

*Commissioner of Patents and Trademarks*